US006993871B2

(12) United States Patent
Richard et al.

(10) Patent No.: US 6,993,871 B2
(45) Date of Patent: Feb. 7, 2006

(54) GUTTER COVER HAVING A UNIQUE INTERLOCKING BRACKET

(75) Inventors: Thomas Roy Richard, Hickory, NC (US); Jason Andrew Herald, Granite Falls, NC (US); Freddie Steven White, Granite Falls, NC (US)

(73) Assignee: Gutter Pro USA LLC, Hickory, NC (US)

( * ) Notice: Subject to any disclaimer, the term of this patent is extended or adjusted under 35 U.S.C. 154(b) by 51 days.

(21) Appl. No.: 10/772,705

(22) Filed: Feb. 5, 2004

(65) Prior Publication Data

US 2005/0000167 A1 Jan. 6, 2005

Related U.S. Application Data

(60) Provisional application No. 60/455,338, filed on Mar. 17, 2003.

(51) Int. Cl.
*E04D 13/00* (2006.01)

(52) U.S. Cl. ..... 52/11; 52/12; 52/13; 248/48.2

(58) Field of Classification Search ..... 52/11, 52/12, 13, 14; 248/48.2, 48.1
See application file for complete search history.

(56) References Cited

U.S. PATENT DOCUMENTS

| | | | | |
|---|---|---|---|---|
| 2,209,741 | A | 7/1940 | Sullivan et al. | |
| 2,271,081 | A | 1/1942 | Layton | |
| 3,444,658 | A * | 5/1969 | Gobel | 52/94 |
| 3,550,381 | A | 12/1970 | South | |
| 4,616,450 | A | 10/1986 | Shouse | |
| 5,271,191 | A | 12/1993 | Vahamaki | |
| 5,398,464 | A | 3/1995 | Jacobs | |
| 5,570,860 | A * | 11/1996 | Schoenherr | 248/48.2 |
| 5,617,678 | A * | 4/1997 | Morandin et al. | 52/11 |
| 5,640,810 | A | 6/1997 | Pietersen | |
| 5,845,435 | A * | 12/1998 | Knudson | 52/11 |
| 6,151,837 | A | 11/2000 | Ealer, Sr. | |
| 6,701,674 | B1 * | 3/2004 | Albracht | 52/12 |
| 6,732,477 | B1 * | 5/2004 | Richard | 52/12 |

* cited by examiner

*Primary Examiner*—Basil Katcheves
(74) *Attorney, Agent, or Firm*—Dougherty Clements; Ralph H. Dougherty; F. Rhett Brockington

(57) ABSTRACT

The invention is a bracket for installing a gutter cover for ducting rainwater to a rainwater gutter, where the gutter cover prevents debris from entering the gutter. The bracket is roughly shaped like three extended fingers, where each finger is a strut. The struts converge at a junction. The various struts are a lifting strut that supports the leading hooked frontal edge of a gutter cover, a stabilizing strut that has a hooked end that interlocks with the hooked edge of a frontal rim of a gutter trough, and a bracing strut that is a leg stemming from the junction to a bottom portion of the gutter.

19 Claims, 7 Drawing Sheets

GUTTER COVER HAVING A UNIQUE INTERLOCKING BRACKET

CROSS REFERENCE TO RELATED APPLICATION

Applicant claims the benefit of the earlier filing date of the provisional application, Ser. No. 60/455,338, which was filed on Mar. 17, 2003.

FIELD OF THE INVENTION

This invention relates generally to a rain gutter, and more particularly to a bracket for mounting a gutter cover on a new rain gutter or an existing rain gutter, wherein the cover is installed using a unique interlocking bracket that does not require fastening devices.

BACKGROUND OF THE INVENTION

The literature is replete with various systems for keeping debris out of rain gutters, while allowing water to freely enter and be conveyed by the gutter.

Layton, U.S. Pat. No. 2,271,081, teaches a rain gutter comprising a "U" shaped trough member supported by hangers, and a cover. The cover (a.k.a. cap) has staggered slots or elongated apertures. The cover is held in place by pins and by nesting with a comparably hooked frontal edge of the trough member.

Ealer, Sr., U.S. Pat. No. 6,151,837, discloses a gutter screen for covering a gutter, where the gutter screen is a cover that prevents debris from falling into the gutter. The gutter screen has a frontal "V" shaped leading edge that attaches to the frontal edge of the trough, which has an inward turned lip, wherein the frontal "V" shaped leading edge receives and secures the inward turned lip. The rear edge of the gutter screen is disposed between a first course of shingles on the roof and the underlining structural roof. Rows of depressed channels are provided in the cover for directing rainwater through slots in the cover. Each channel and slot is sized so that water is directed into the channel through the slot and into the gutter, and such that debris is not trapped in the channel or the slot. There is no discussion of how the cover is supported across the width of a sectional length of cover.

Pietersen, U.S. Pat. No. 5,640,810, discloses a gutter cover for reducing the amount of debris entering a gutter. The cover is positioned over a gutter by having a rear fastenable edge that is secured between a first course of shingles and the underlining structural roof, and a frontal edge that rests upon the frontal edge of the gutter. The cover, which is comprised of an elastic material, has a thin portion, which acts as a living hinge, therein allowing the cover to pivot upwards away from the gutter frontal edge, for repair and cleaning. The cover is provided with a plurality of recessed perforations, which receive rainwater while debris washes over the cover.

Vahamaki, U.S. Pat. No. 5,271,191, teaches a gutter shield which covers and prevents debris from entering through the open top of a gutter. The gutter shield is attached to the gutter by a frontal edge, which is fastened by screws to the gutter and a rear edge flange secured between the first course of shingles and the underlining structural roof. The shield has a plurality of parallel vanes, of which each has a series of slots for receiving rainwater. The slots are sized so that debris will not pass into the gutter.

South, U.S. Pat. No. 3,550,381, teaches a perforated cover which attaches over the top of a rain gutter. The gutter is provided with frontal and rear edges (both upper and lower) having an "U" shaped channel, and periodic vertical mounting devices having an upper downward directed "U" and a lower upward directed "U" (i.e. like a curtain rod), wherein the bracket serves as an interlocking channel to secure the back wall of the gutter. The perforated cover has an "U" shaped rear edge, and a flanged frontal edge, such that the frontal edge of the gutter receives the flange of the cover, and the upper rear edge of the gutter receives the "U" shaped rear edge of the cover, wherein the rear edge of the cover is also partially secured by the mounting device. There is no discussion of how the cover is supported across the width of a sectional length of cover.

Shouse, U.S. Pat. No. 4,616,450, teaches a rain gutter having a gutter shield for preventing the ingress of particulates into the gutter. The gutter shield has a solid upper surface and a generally vertical frontal surface that has a first row of rain guiding apertures and a second row of rain receiving apertures inscribed therein.

Sullivan et al., U.S. Pat. No. 2,209,741, discloses a removable screen attached over a top portion of a gutter to prevent entrance of foreign material into the gutter.

Jacobs, U.S. Pat. No. 5,398,464, discloses a gutter system having a strap for supporting a screen on the gutter. The screen allows the passage of rainwater there while preventing the entrance of foreign material into the gutter.

In general, all of the foregoing systems are designed to be installed as a complete unit, and are not suitable for retrofitting an existing rain gutter. Another characteristic of the present invention is that the prior art does not disclose the use of supports across the width of a sectional length of cover. Supports add strength to long sections of cover, which can be subjected to substantial weight if debris collects on the cover. The majority of existing rain gutters are simple troughs, fabricated out of aluminum sheet metal. Each trough is reinforced with an "L" shaped cross-strut, that simultaneously braces the front wall of the trough and affixes the back wall to the eave of the roof. What is desired is a fastening system for gutter covers that can be easily affixed to a new rain gutter and/or retrofitted to an existing gutter, wherein the fastening system requires only a minimal number of mechanical fastening elements selected from the group consisting of staples, screws or nails. What is further desired is a fastening system gutter cover that provides support without the use of any visible mechanical fastening elements, as mechanical fastening elements can easily distort the gutter cover during installation.

SUMMARY OF THE INVENTION

The present invention is a bracket for mounting a gutter cover, wherein the gutter cover is facilely retrofitted to an existing rain gutter as well as a new rain gutter. The invention is particularly suited for use with an aluminum sheet metal rain guttering. The trough of guttering has a main channel with a curvilinear front wall and a rear wall that is usually substantially straight. The gutter cover bracket is comprised of a lifting strut, at least one bracing strut, a stabilizing strut, and a junction where the struts converge. The lifting strut has a distal end that can provide support to a leading hooked frontal edge of the gutter cover, and a proximal end that intersects the junction of the bracket. The bracing strut has a lower end, which can rest on a bottom portion of the gutter trough, and an upper end that intersects the junction of the bracket, therein providing support to the junction. The bracing strut is of sufficient length and shape so that support can be achieved without blocking the main channel of the rain gutter. Several variations create the desired support for the cover. An angled bracing strut is angled so that the lower end rests adjacent to the front wall of the main channel. A linear bracing strut rests adjacent to the rear wall of the channel. A curvilinear bracing strut follows a contour of the front wall of the gutter trough. The bracket can be comprised of more than one bracing strut, for instance the bracket can have an angled bracing strut and a curvilinear bracing. The stabilizing strut has a hooked end that can distally interlock with a hooked edge of a front rim of a gutter trough and a medial end that intersects with the junction of the bracket. The stabilizing strut and the bracing strut have lengths such that the junction will be positioned in the gutter substantially medial to the trough and proximal to the front rim of the gutter when the bracket is mounted. To enhance the strength of the stabilizing strut and the lifting strut, there can additionally be at least one connecting element, where the connecting element spans from the stabilizing strut to the lifting strut.

Aluminum rain guttering is installed with fastening devices, which are attached to a fascia plank. A fastening device typically has two sectional components, a cross-strut for supporting the front wall of the trough and a hanging strap for supporting the rear wall. In some variations of the fastening device the bottom of the trough is supported. The invention enables quick installation of the gutter cover. The brackets are positioned along the trough at intervals sufficient to provide support to the cover. The interval between brackets will vary depending on the gauge and the width of the cover, but a practical range is 1–8 feet. The brackets are secured to the front wall of the trough by simply interlocking the hooked end of the stabilizing strut of the bracket with the hooked edge of a frontal rim of the trough. The gutter cover is aligned over the trough and then a longitudinal rear edge of the cover is inserted under a course of shingles or against the fascia plank of the roof. The cover is pushed until the leading hooked frontal edge of a gutter cover is contacting the distal end of the lifting strut of the bracket. The cover is then secured to the roof with a fastening means. In a preferable embodiment of the bracket, the distal end of the lifting strut has a curved end that has the same curvature as the hooked frontal curved edge of the cover, therein the penetration of the distal end of the lifting strut into the hooked frontal edge of the cover creates a partially interlocking attachment. The attachment prevents the cover from lifting in high winds, and becoming dislodged from the gutter.

The bracket is fabricated of materials that have good performance and outside aging characteristics. Preferred materials can be cast or extruded, such as plastics or metals or composites. Examples of inorganic materials are aluminum, aluminum alloys, weather resistant grades of iron alloys, copper, weather resistant grades of copper alloys, ceramics and glass. Examples of organic materials are PVC, certain grades of polypropylenes, polyethylenes, phenolic resins, polyurethane, polyamides, chlorinated polyethylene, polychloroprene, polyacrylates, polymethacrylates, polyvinylidene chloride, polycarbonates, polyvinylketals, polyvinylaldehydes, polyesters, blends of polyester, acrylonitrile-butadiene-styrene, compounded natural rubber(s), synthetic rubber(s) and blends of rubber. The materials can be cured or uncured, and can contain fibers, fillers, microspheres, antioxidants, UV stabilizers, carbon blacks, processing aids, waxes, antimicrobial agents, and other compounding agents. An example of a cured material that is a composite is a fiberglass reinforced plastic. Other materials exhibiting promise are cellular products including treated wood and rigid foams, such as polyurethane foams used in outdoor signage. The bracket can contain ridges and/or voids so as to reduce material expense and optimize strength.

The fastening means for connecting the cover is selecting from the group consisting of: nails, staples, screws, or similar fastening devices. The cover is seated so that it slopes downward from the fascia plank or the roof toward the front wall of the trough. The longitudinal hooked frontal edge terminates inside the trough.

When a gutter cover is installed utilizing the invention, the cover deflects debris and collects rainwater. Rainwater coming off the roof is ducted across and down the width of the flat sheet of the cover, and flows, circumferentially, around a curved path and down the longitudinal hooked frontal edge, and drops off into the trough. The upper surface of the cover is coated so as to be easily wetted by water, such that surface tension is sufficient so that the rainwater adheres to the surface. The rainwater's adhesion to the surface of the cover causes the water to track through an arc scribed by the longitudinal hooked frontal edge, without flying off tangentially. Debris is deflected by the cover, and except for small detritus conveyed by the rainwater, debris is excluded. The surface of the cover does not have any projections onto which straw, leaves, etc. can hang up and collect. Also the surface does not become easily fouled.

The shape of the bracket can be selected so that it lends itself to being manufactured via extrusion, for instance like pipe, which is continuously extruded and then cut into the desired lengths. The bracket is extruded and cut into widths, like ribs, thereby making the bracket very inexpensive to manufacture.

OBJECTS OF THE INVENTION

The principal object of the invention is to provide a bracket that enables a gutter cover to be easily installed to a gutter.

A second object of the invention is to provide a bracket for gutter covers, wherein the bracket can be secured to a gutter trough without the use of fastening devices such as nails, staples, screws, or similar fastening devices.

A third object of the invention is to provide a gutter cover that excludes debris, while collecting rainwater, wherein the gutter cover is supported with brackets that are stabilized by a stabilizing strut having a hooked end that distally interlocks with the hooked edge of a frontal rim of a gutter trough and medially intersects the junction of the bracket.

A fourth object of the invention is to provide a bracket that has good performance and weather resistance over a range of temperature conditions, where for instance in cold weather the bracket does not become brittle, and in hot weather the bracket does not distort.

A fifth object of the invention is to provide a bracket having a partially interlocking attachment with the cover, where the attachment prevents the cover from lifting in high winds, and becoming dislodged from the gutter.

BRIEF DESCRIPTION OF THE DRAWINGS

The foregoing and other objects will become more readily apparent by referring to the following detailed description and the appended drawings in which.

DETAILED DESCRIPTION OF THE INVENTION

Figure 1:
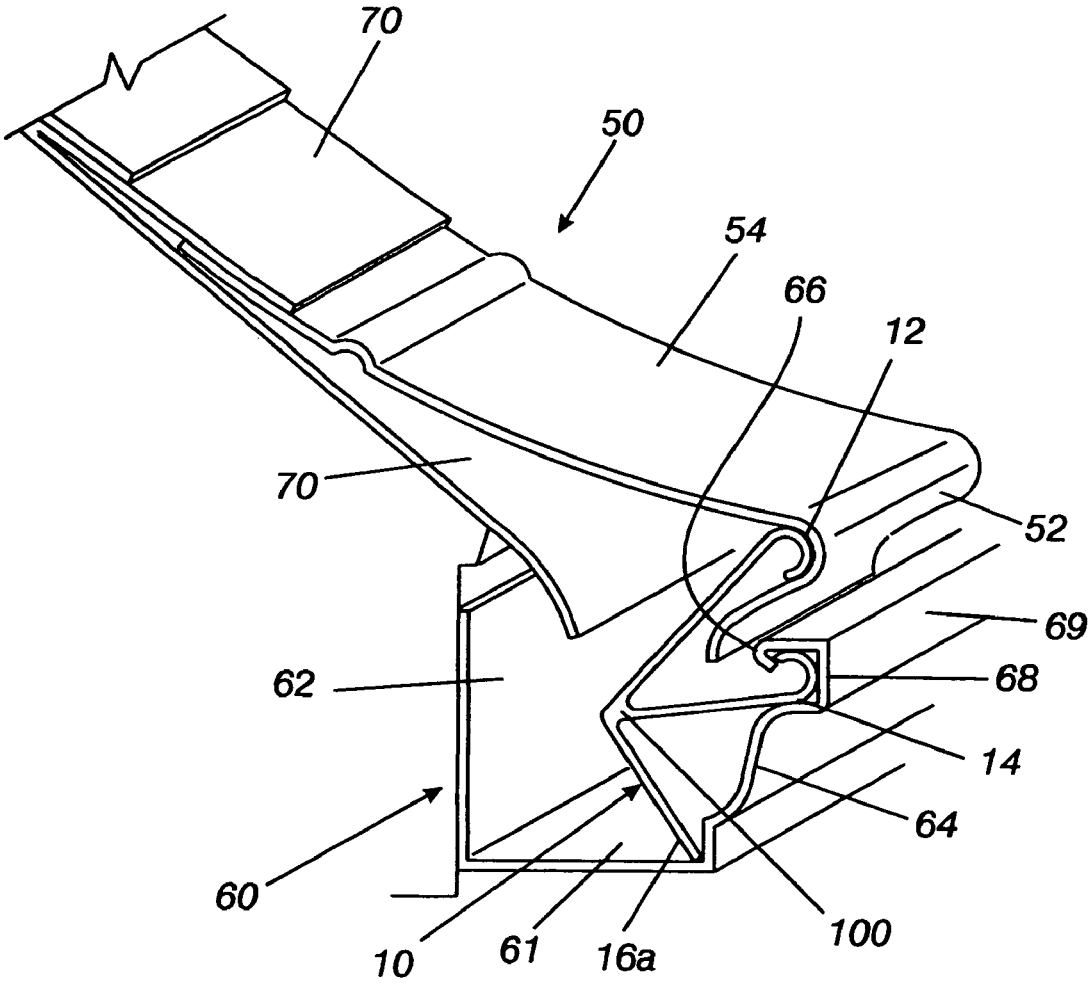
FIG. 1 is a perspective view of an aluminum sheet-metal gutter having a gutter cover that is installed using the invented bracket.
Figure 3:
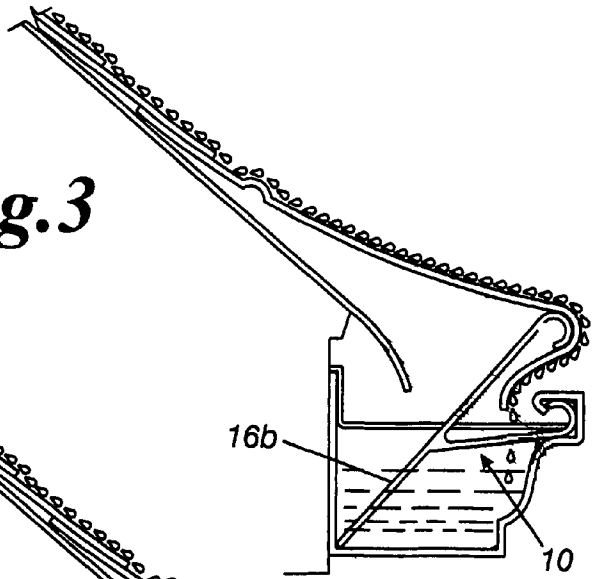
FIG. 3 is a side view of the gutter cover with the quick fastening bracket as it is installed on an aluminum sheet-metal gutter, where the bracket has a bracing strut that rests on the rear edge of the tough channel.
Figure 4:
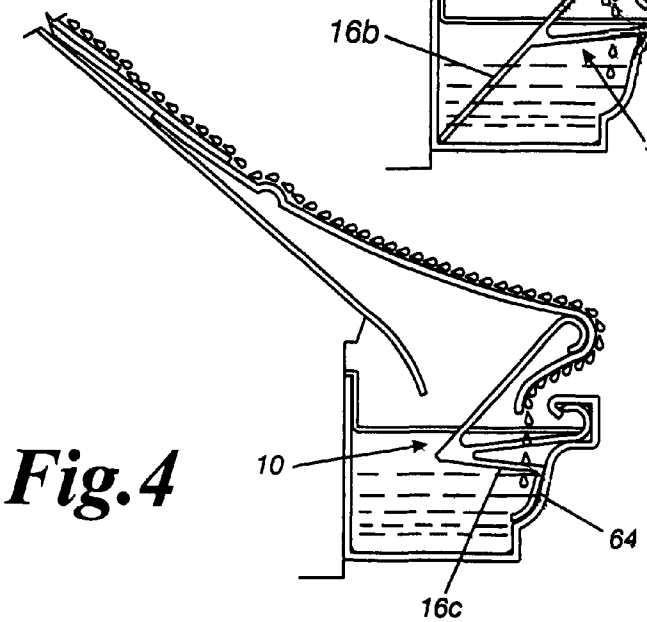
FIG. 4 is a side view of the gutter cover with the quick fastening bracket as it is installed on an aluminum sheet-metal gutter, where the bracket has a bracing strut that rests on the front wall of the tough channel.
Figure 2:
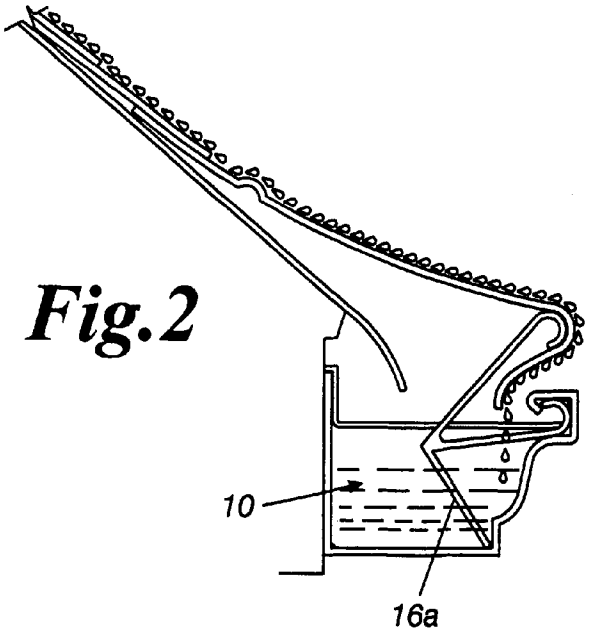
FIG. 2 is a side view of the gutter cover with the quick fastening bracket as it is installed on an aluminum sheet-metal gutter, where the bracket has a bracing strut that rests on the front edge of the tough channel.
Figure 5:
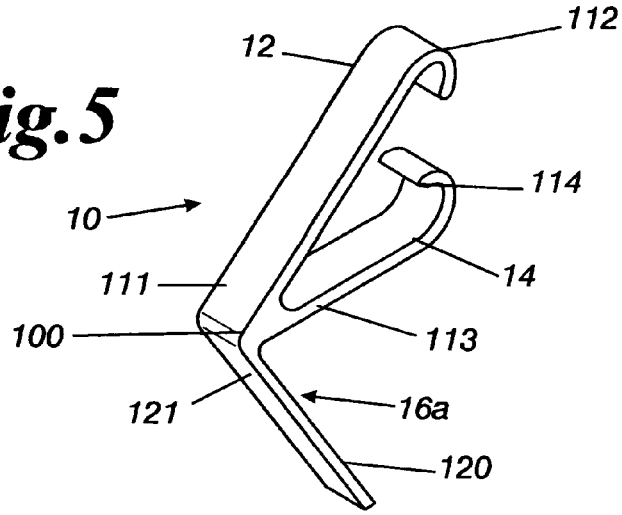
FIG. 5 is a perspective view of the bracket having an angled bracing strut.
Figure 6:
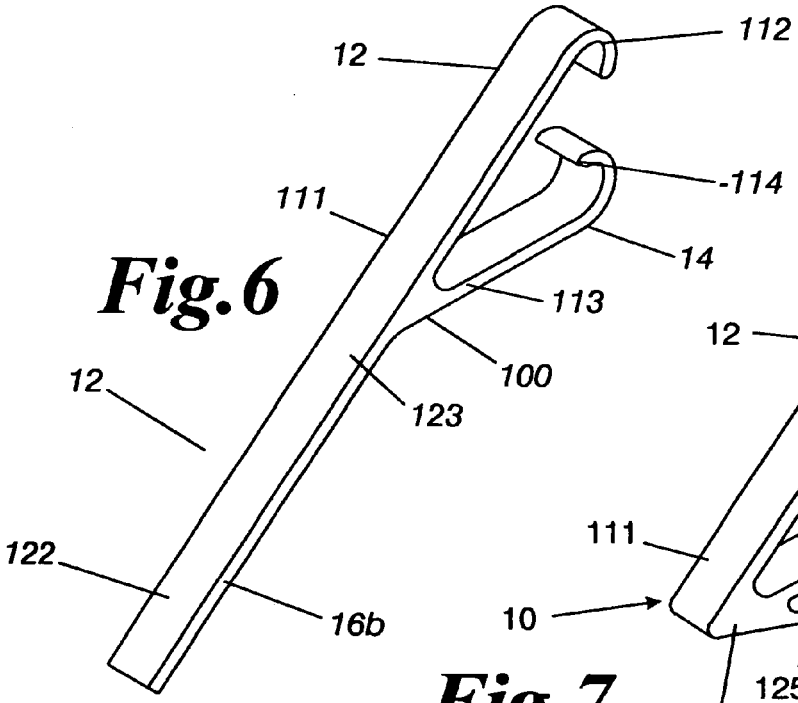
FIG. 6 is a perspective view of the bracket having a linear bracing strut.
Figure 7:
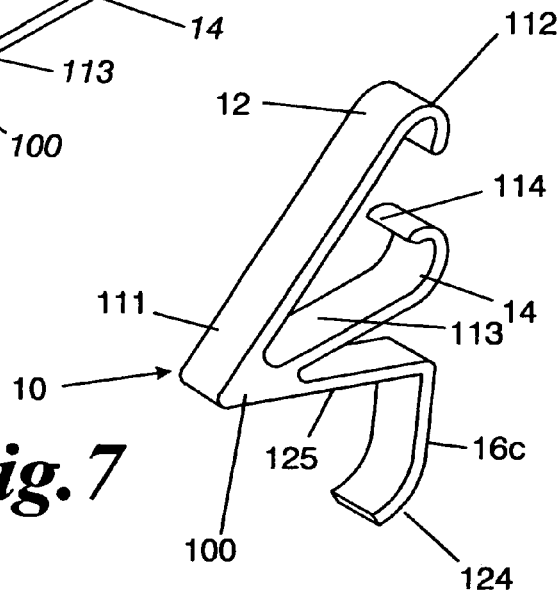
FIG. 7 is a perspective view of the bracket having a curvilinear bracing strut.

Referring now to the drawings, and particularly to FIG. 1, the invention is a bracket 10 for mounting a gutter cover 50. The gutter cover 50 is installed on a sheet-metal rain gutter 60, preferably of aluminum. The rain gutter as shown in FIG. 1 has a trough 60 with a front wall 62, a bottom 61 and a rear wall 62. The illustrated gutter cover 50 has substantially flat region 54, that is coextensive and underlying a course of shingles 70. The cover 50 is supported by a lifting strut 12 that extends from the junction 100 of the bracket 10. The distal end of the lifting strut 12 is curved, and protrudes into the inner surface frontal curved portion 52 of the cover 50. The bracket 10 in the illustrated embodiment in FIG. 1 is also shown in FIG. 2 and FIG. 5. Referring to FIG. 5, the bracket 10 has three struts, the lifting strut 12, the bracing strut 16 (which is variously embodied as 16*a*, 16*b*, 16*c* and 16*d*), and the stabilizing strut 14. The three struts converge at junction 100. The distal end 112 of the lifting strut is curved, where the curvature matches the curvature of the curved portion 52 of the frontal edge of the cover 10. The proximal end 111 of the lifting strut is integral to the bracket 10 at junction point 100. A stabilizing strut 14 has a hooked end 114 that is interlocked into the folded edge 66 of rim 68. Similarly, the stabilizing strut 14 is integral to the bracket 10 at junction point 100 at the medial end 113. FIGS. 5–7 also illustrate various embodiments of a bracing strut. The bracing strut 16 can be angled 16*a*, as shown in FIG. 5, straight 16*b* as shown in FIG. 6, or curvilinear 16*c* as shown in FIG. 7. The angled bracing strut 16*a*, as shown in FIG. 5, has lower end 120, and an upper end 121, which is integral to the junction 100. The straight bracing strut 16*b*, as shown in FIG. 6, has lower end 122, and an upper end 123, which is integral to the junction 100. As shown in FIG. 7, the curvilinear bracing strut 16*c* has a lower end 124, which is curved, and an upper end 125, which is integral to the junction 100. Depending on the embodiment, the bracing strut contacts different portions of the trough 60. FIGS. 2–4 illustrate the angled strut 16*a* resting on the front of the trough 60, the straight strut 16*b* resting on the rear of the trough, and the curvilinear strut 16*c* resting on the front wall 64 of the gutter trough.

Figure 10:
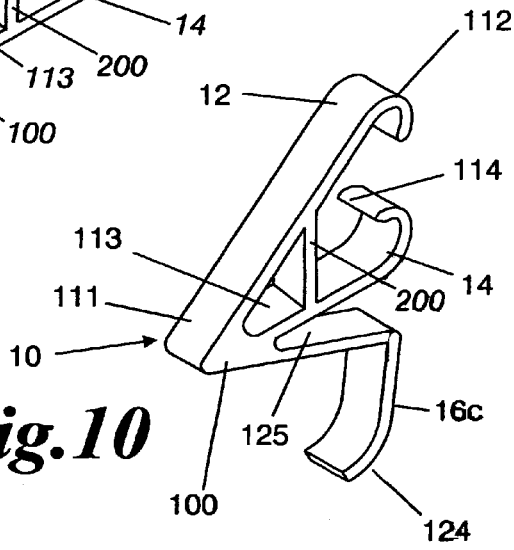
FIG. 10 is a perspective view of a curvilinear bracing strut bracket, as shown in FIG. 7, having a connecting element that spans from the stabilizing strut to the lifting strut.
Figure 11:
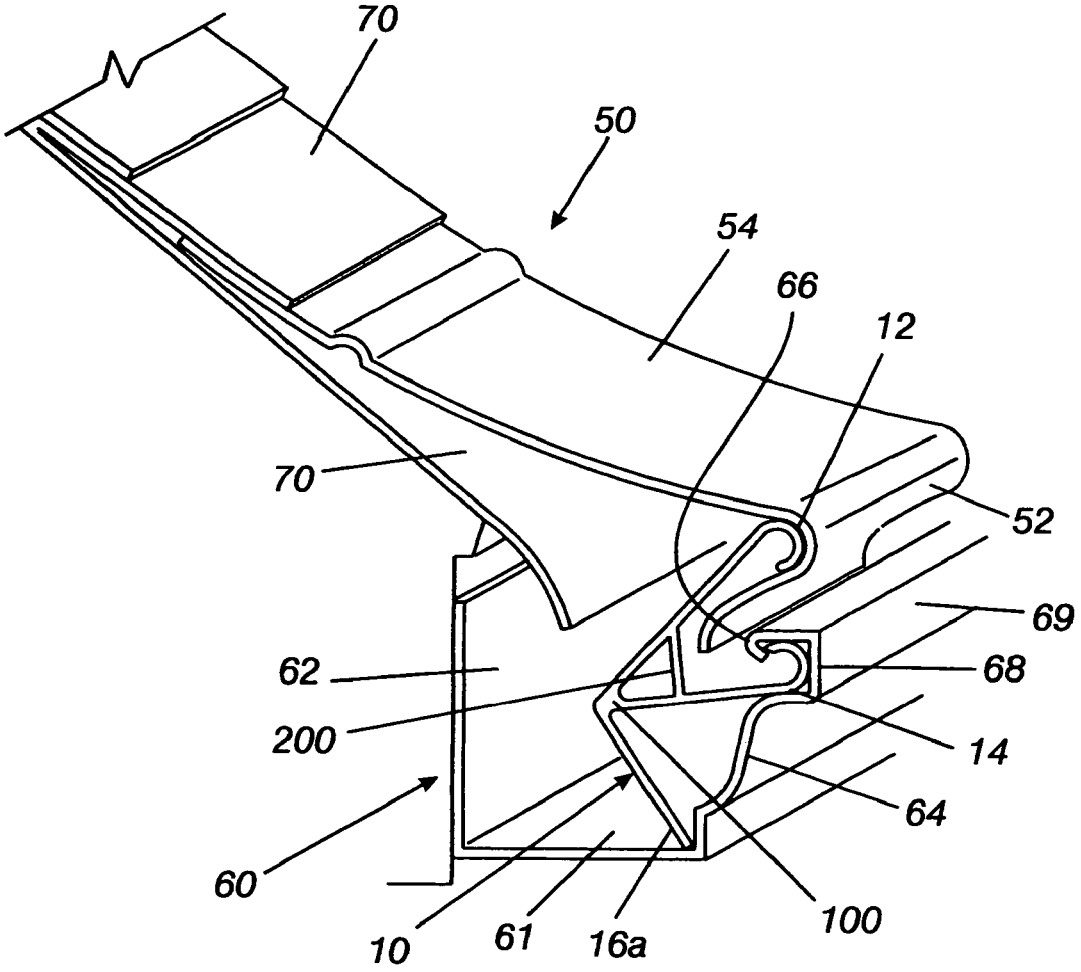
FIG. 11 is a perspective view of an aluminum sheet-metal gutter having a gutter cover installed with the angled bracing strut bracket with a connecting element, as illustrated in FIG. 8.

As shown in FIGS. 8–11, the bracket 10 can be further comprised of at least one connecting element 200, where the connecting element spans from the stabilizing strut 14 to the lifting strut 12. FIG. 11 illustrates the application of a bracket 10 with an angled strut 16*a* and a connecting element 200.

Figure 8:
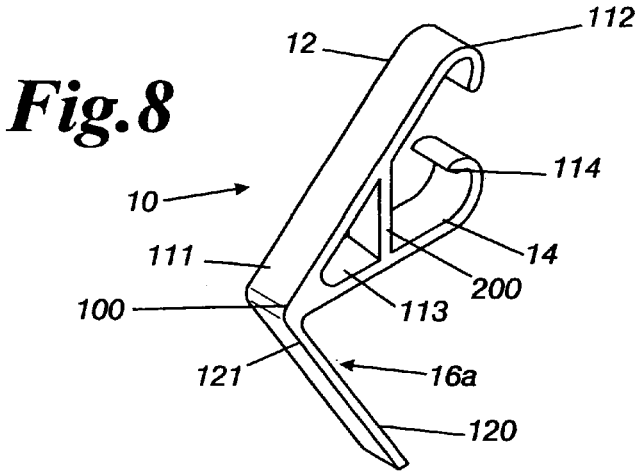
FIG. 8 is a perspective view of an angled bracing strut bracket, as shown in FIG. 5, having a connecting element that spans from the stabilizing strut to the lifting strut.
Figure 9:
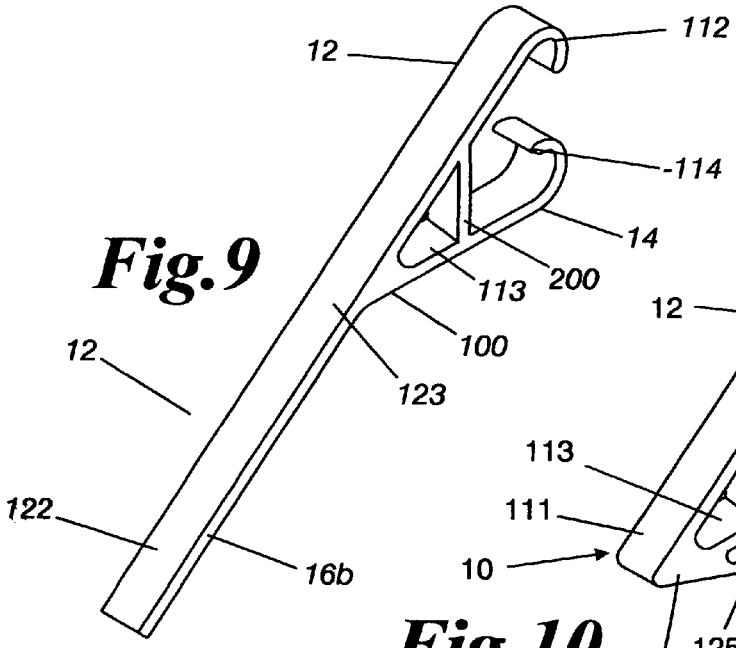
FIG. 9 is a perspective view of a linear bracing strut bracket, as shown in FIG. 6, having a connecting element that spans from the stabilizing strut to the lifting strut.
Figure 12:
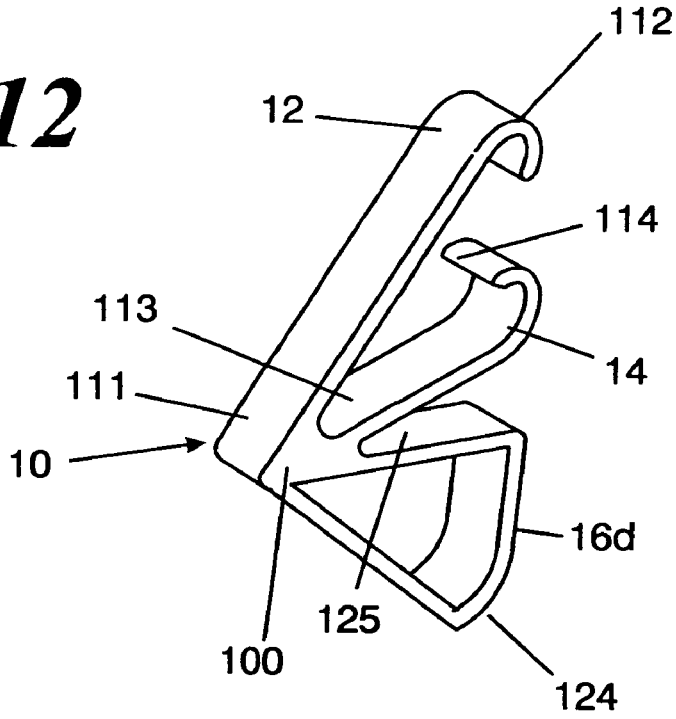
FIG. 12 is a perspective view of a bracket having two bracing struts, an angled strut and a curvilinear strut, where the angled strut is contiguous with the curvilinear strut.

FIG. 12 illustrates a bracket 10 having a composite of two bracing struts 16*d*, an angled strut 16*a* as shown in FIG. 8, and a curvilinear strut 16*c* as shown in FIG. 10. The additional bracing strut adds strength to the bracket.

Figure 13:
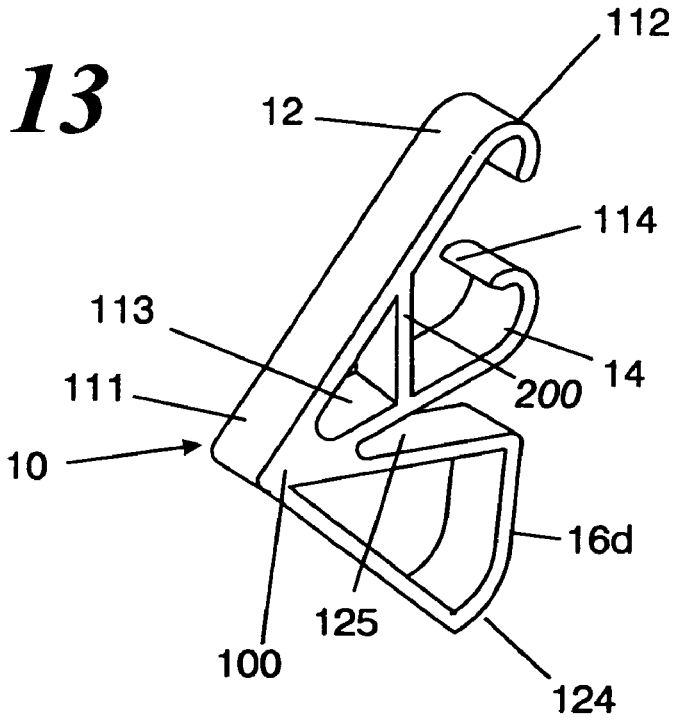
FIG. 13 is a perspective view of the bracket illustrated in FIG. 12, wherein the bracket additionally has a connecting element that spans from the stabilizing strut to the lifting strut.

FIG. 13 illustrates a bracket 10 having a composite of two bracing struts 16*d*, and a connecting element 200 that spans from the stabilizing strut 14 and the lifting strut 12.

Figure 14:
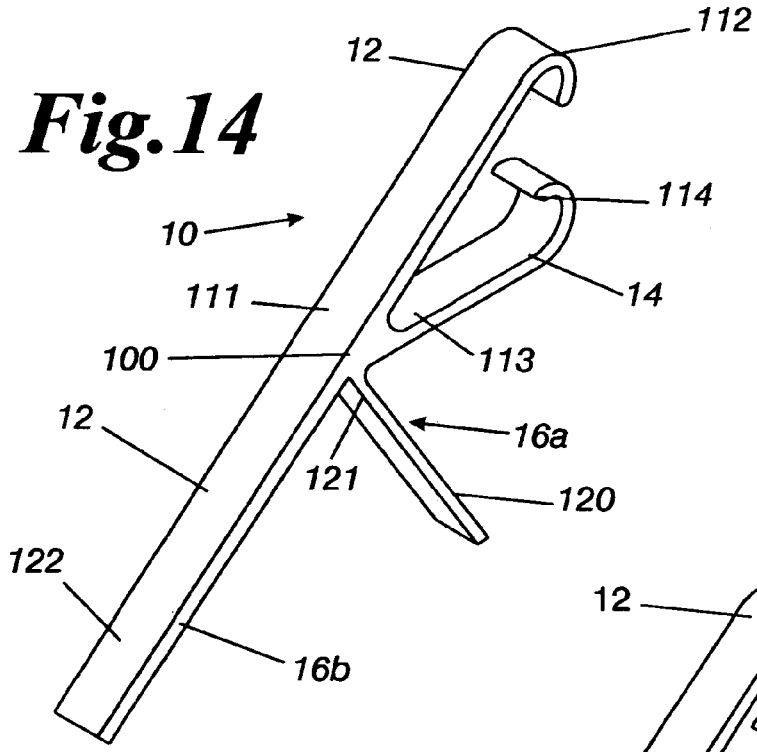
FIG. 14 is a perspective view of a bracket having two bracing struts, an angled strut, and a linear strut.
Figure 15:
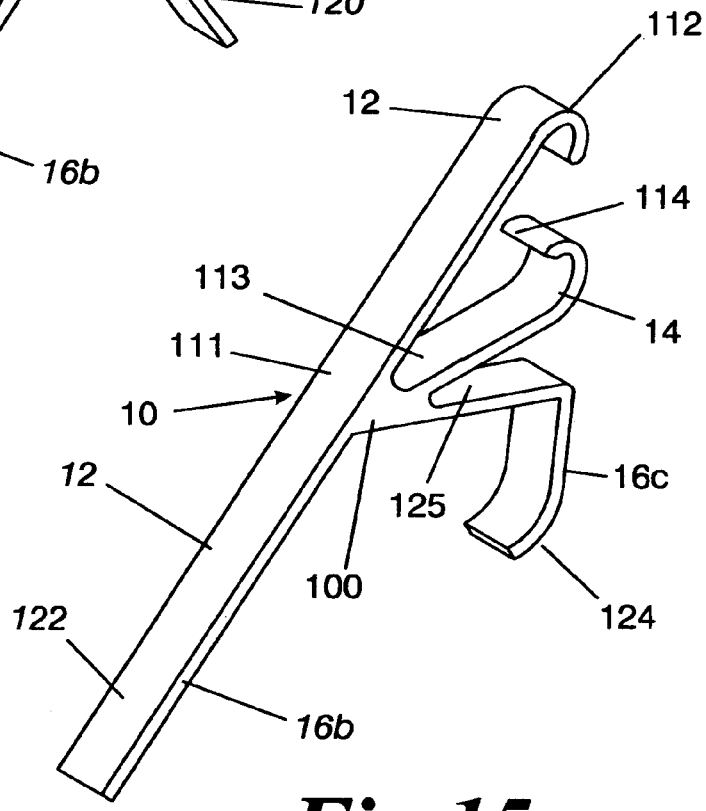
FIG. 15 is a perspective view of a bracket having two bracing struts, a linear strut, and a curvilinear strut.

Other embodiments of the bracket 10 having two bracing struts are illustrated in FIG. 14 and FIG. 15. A bracket having an angled strut 16*a* and a linear strut 16*b* is shown in FIG. 14. A bracket 10 having a curvilinear strut 16*c* and a linear strut 16*b* is shown in FIG. 15. A common feature in all of the illustrated embodiments is that the stabilizing strut and the bracing strut have lengths such that the junction will be positioned in the gutter substantially medial to the trough and proximal to the front rim of the gutter when the bracket is mounted.

The bracket 10, as illustrated in the drawings, has a stabilizer strut 12 having a thickness that is narrower than gap created by the folded edge 66 of rim 68. The curvature is high enough that the hooked end 114 of the stabilizing strut 14 will insert into the space defined by the fascia edge 69 (as seen in FIG. 1) of the gutter 60 and engage the folded edge 66. The lifting strut 12 does not have similar thickness constraint. It is partially limited only by the curvature of the frontal edge 52 of the cover 50. An arced lifting strut 12 would enable the use of a thicker strut, and the inventors recognize this as a potential variation of the bracket. Similarly, there is no limitation on the thickness of the bracing strut 16, except that as it becomes thicker it possibly could begin to effect drainage and becomes more expensive. The various struts need not be the same thickness, and can be as wide as is practical, where practical is a function of the cost of manufacturing, and the cost of installation. The various struts can also have strength members like the previously discussed connecting elements, and can be further engineered to optimize the shape. The illustrated embodiments lend themselves to extrusion manufacturing, wherein the bracket is extruded like pipe, and cut into the desired width.

It is anticipated that individual features of the bracket can be changed, however, with substantially no effect on the overriding functionality and operative elements. Likewise, the cover can be also be modified, as illustrated in the embodiments to adopt to different mounting needs, albeit also with substantially no effect on the overriding functionality and operative elements.

SUMMARY OF THE ACHIEVEMENT OF THE OBJECTS OF THE INVENTION

From the foregoing, it is readily apparent that I have invented a bracket for mounting a gutter cover that easily retrofits onto a new or an existing gutter. The bracket simplifies installation of gutter covers. The bracket is secured to a gutter trough without the use of fastening devices such as nails, staples, screws, or similar fastening devices, and minimizes the installation time for installing a gutter cover.

The bracket is comprised of materials that have good performance and weather resistance over a range of temperature conditions. In cold weather the bracket does not become brittle, and in hot weather the bracket does not distort.

Furthermore, what is provided is a bracket that has a partially interlocking attachment with the cover, whereby the attachment prevents the cover from lifting in high winds, and becoming dislodged from the gutter.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A bracket for mounting a gutter cover over a gutter where the gutter has a trough with a rear wall, a bottom and a front wall with a front rim having a folded edge, said bracket comprising:

a) a junction for at least three struts;

b) a lifting strut having a distal end that can supports a frontal edge of the gutter cover, and a proximal end that is integral to the junction;

c) a stabilizing strut having a distal hooked end that can interlock with the folded edge of the front rim of the gutter and a medial end that is integral to the junction;

d) at least one bracing strut having a distal lower end and an upper end that is integral with the junction, wherein the at least one bracing strut is angled so that the distal lower end will contact the bottom of the gutter or the front wall of the gutter or a combination thereof; and wherein the stabilizing strut and the bracing strut have lengths such that when the bracket is mounted the junction will be positioned in the gutter substantially medial to the trough and proximal to the front rim of the gutter.

2. The bracket for mounting a gutter cover to a gutter, as claimed in claim 1, wherein said bracing strut is angled so that the lower end of the bracing strut rests on the bottom adjacent to the front wall of the gutter.

3. The bracket for mounting a gutter cover to a gutter, as claimed in claim 1, wherein said bracing strut is straight so that the lower end of the bracing strut rests on the bottom adjacent to the rear wall of the gutter.

4. The bracket for mounting a gutter cover to a gutter, as claimed in claim 1, wherein said bracing strut is curvilinear so that the bracing strut substantially follows the contours of the front wall of the gutter.

5. A bracket for mounting a gutter cover to a gutter according to claim 1, wherein said bracket further comprises at least one connecting element, where the at least one connecting element spans from the stabilizing strut to the lifting strut.

6. The bracket for mounting a gutter cover to a gutter according to claim 1, wherein the at least one bracing strut is comprised of a curvilinear brace and an angled brace.

7. A bracket for mounting a gutter cover to a gutter according to claim 6, wherein said bracket further comprises at least one connecting element, where the at least one connecting element spans from the stabilizing strut to the lifting strut.

8. The bracket for mounting a gutter cover to a gutter, as claimed in claim 1, wherein the distal end of the lifting strut has a curvature that is comparable to the hooked frontal curved edge of the cover, thereby creating a partially interlocking attachment to the frontal curved edge of the cover.

9. The bracket for mounting a gutter cover to a gutter according to claim 8, wherein the at least one bracing strut is comprised of a curvilinear brace and an angled brace.

10. A bracket for mounting a gutter cover to a gutter according to claim 9, wherein said bracket further comprises at least one connecting element, where the at least one connecting element spans from the stabilizing strut to the lifting strut.

11. A bracket for mounting a gutter cover to a gutter according to claim 8, wherein said bracket further comprises at least one connecting element, where the at least one connecting element spans from the stabilizing strut to the lifting strut.

12. A bracket for mounting a gutter cover to a gutter according to claim 8, wherein said bracket further comprises at least one connecting element, where the at least one connecting element spans from the stabilizing strut to the lifting strut.

13. The bracket for mounting a gutter cover to a gutter according to claim 1, wherein the bracket has a structure that lends itself to being formed by continuous extrusion, and cutting the bracket to the desired width.

14. The bracket for mounting a gutter cover to a gutter according to claim 13, wherein the bracket has a composition that lends itself to extrusion, has good outside aging and performance properties, wherein the composition is selected from plastics, glasses, ceramics, metals, and composites.

15. The bracket for mounting a gutter cover to a gutter according to claim 14, wherein the metals are selected from the group consisting of: aluminum, aluminum alloys, weather resistant grades of iron alloys, copper, and weather resistant grades of copper alloys.

16. The bracket for mounting a gutter cover to a gutter according to claim 14, wherein the plastics are selected from the group consisting of: PVC, certain grades of polypropylenes, polyethylenes, phenolic resins, polyurethane, polyamides, chlorinated polyethylene, polychloroprene, polyacrylates, polymethacrylates, polyvinylidene chloride, polycarbonates, polyvinylketals, polyvinylaldehydes, polyesters, blends of polyester, acrylonitrile-butadiene-styrene, compounded natural rubber(s), synthetic rubber(s), and blends of rubber.

17. The bracket for mounting a gutter cover to a gutter according to claim 16, wherein the composites are formed from plastics listed in claim 16 and inorganic materials selected from the following group consisting of: cellulosic fibers, glass beads, glass fibers, titanium oxide, magnesium oxide, calcium carbonate, inorganic sulfates, talcs, polyester fibers, silicates, and powdered carbons.

18. The bracket for mounting a gutter cover to a gutter according to claim 14, wherein the composition can also contain processing aids, waxes, antioxidants, UV stabilizers, antimicrobial agents, and other weathering agents.

19. A method for installing a gutter cover over new or a preexisting gutter, where the gutter has a rear wall, a bottom and a front wall, on a roof using a bracket comprised of: a junction for at least three struts; a lifting strut having a distal end that supports a frontal edge of the gutter cover, and a proximal end that is integral to the junction; a stabilizing strut having a distal hooked end that can interlock with a folded edge of a front rim of the gutter and a medial end that is integral to the junction; and at least one bracing strut having a distal lower end and an upper end that is integral with the junction, wherein the at least one bracing strut is angled so that the distal lower end will contact the bottom of the gutter or the front wall of the gutter or a combination thereof, and the upper end will provide support to the lifting strut through the junction, wherein the stabilizing strut and the bracing strut have lengths such that the junction will be positioned in the gutter substantially medial to the trough and proximal to the front rim of the gutter when the bracket is mounted, said method comprises the steps of:

positioning brackets along the trough at intervals sufficient to provide support to the cover, by interlocking the hooked end of the stabilizing strut into the frontal rim of the gutter, thereby stabilizing the junction substantially medial to the gutter, and the distal lower end of the bracing strut contacts the bottom of the gutter or the front wall of the gutter or a combination thereof;

aligning the cover over the gutter, wherein a longitudinal rear edge of the cover is inserted under a course of shingles or against the fascia plank of the roof;

pushing the cover against the roof until the leading hooked frontal edge of the gutter cover is contacting the distal end of the lifting strut of the bracket; and securing the cover to the roof with a fastening means.

* * * * *